US009259092B2

(12) United States Patent
Choi

(10) Patent No.: US 9,259,092 B2
(45) Date of Patent: Feb. 16, 2016

(54) CUP HOLDER FOR CHAIR

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 14/735,805

(22) Filed: Jun. 10, 2015

(65) Prior Publication Data

US 2015/0359344 A1 Dec. 17, 2015

(30) Foreign Application Priority Data

Jun. 11, 2014 (CN) ..... 2014 2 0308503

(51) Int. Cl.
*A47K 1/08* (2006.01)
*A47C 7/62* (2006.01)

(52) U.S. Cl.
CPC ..... *A47C 7/62* (2013.01)

(58) Field of Classification Search
CPC ..... A47C 7/62
USPC ..... 248/309.1, 311.2, 312.1; 220/8, 288
See application file for complete search history.

(56) References Cited

U.S. PATENT DOCUMENTS 5,356,107 A * 10/1994 Sinohuiz ..... A47C 7/62 248/223.41
5,893,605 A * 4/1999 Chang ..... A47C 7/68 297/16.2
2010/0308042 A1* 12/2010 Faris ..... B65D 11/02 220/8
2011/0248037 A1* 10/2011 Fung ..... B65D 21/0219 220/592.2
2011/0248040 A1* 10/2011 McGregor ..... B65D 21/086 220/666
2011/0303659 A1* 12/2011 Perlman ..... A45F 3/20 220/8
2013/0264340 A1* 10/2013 Zens ..... B65D 21/086 220/8

FOREIGN PATENT DOCUMENTS

DE 19540528 A1 * 5/1996 ..... A45F 3/20

* cited by examiner

*Primary Examiner* — Gwendolyn Baxter
(74) *Attorney, Agent, or Firm* — Morgan, Lewis & Bockius LLP

(57) ABSTRACT

A cup holder for a chair includes a cup holder fixing seat, a cup holder middle sleeve and a cup bottom. The fixing seat includes a connecting part and a first limiting rim. The middle sleeve includes second and third limiting rims and at least one first detention. The cup bottom includes a fourth limiting rim and at least one second detention. The second limiting rim is slidable along an inner wall of the fixing seat, and the fourth limiting rim is slidable along an inner wall of the middle sleeve. When unfolded, the second limiting rim of the middle sleeve is seated on and supported by the first limiting rim of the fixing seat, the fourth limiting rim of the cup bottom is seated on and supported by the third limiting rim of the middle sleeve.

5 Claims, 4 Drawing Sheets

CUP HOLDER FOR CHAIR

CROSS-REFERENCE TO RELATED APPLICATION

The present application claims priority of Chinese Utility Model Application Number 201420308503.0 filed Jun. 11, 2014, the entire contents of which application are incorporated herein for all purposes by this reference.

FIELD OF INVENTION

The present invention relates to a cup holder for a chair, and more particularly, to a cup holder for a leisure chair.

DESCRIPTION OF RELATED ART

Chairs such as leisure chairs, which bring a comfortable and fashionable home life to people, have become essential furniture when going out for a picnic or seaside leisure. Normally, when going out for a picnic, doing outdoor activities, or enjoying an outdoor living, for the convenience of using and folding/unfolding, people mostly choose the foldable leisure chairs, lying chairs, or other similar chairs to sit on or have a rest on them. Currently, the chairs are designed in structures and shapes to be suitable for leisure, and people when sitting on them may feel relax and recover from fatigue. However, those chairs usually are not provided with cup holders, so if people want to have a drink, they need to additionally put a tea table or a small table to place the drink, which obviously brings about more inconvenience. Therefore, it is a very favorable design to arrange a cup holder on the leisure chair. The existing cup holders have the deficiencies of having a complicated structure, time consuming in the preparation process, and a high cost, and occupying a certain space after folding, so there is a demand for developing a design of seat/chair cup holder which has a simple structure and occupies least space.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, an objective of the present invention is to provide a cup holder for a chair such as a leisure chair, which has a simple structure, is simple to detach and mount, and easy to operate, and is foldable and occupies minimal space when folded.

In various embodiments, the present invention provides a cup holder for a chair including a hollow cup holder fixing seat, a hollow elastic cup holder middle sleeve, and an elastic cup bottom. An exemplary hollow cup holder fixing seat includes a connecting part for removably attaching the cup holder to a frame of the chair, and a first limiting rim extended radially inward from a lower edge of the cup holder fixing seat. An exemplary hollow elastic cup holder middle sleeve includes a second limiting rim extended radially outward from an upper edge of the elastic cup holder middle sleeve, a third limiting rim extended radially inward from a lower edge of the elastic cup holder middle sleeve, and at least one first detention formed at a bottom of an outer wall of the elastic cup holder middle sleeve. The elastic cup bottom includes a fourth limiting rim extended radially outward from an upper edge of the elastic cup bottom, and at least one second detention formed at a bottom of an outer wall of an elastic cup bottom.

In an exemplary embodiment, the cup holder of the invention includes one or more than one of the following characteristics: an inner diameter of the cup holder fixing seat is larger than an outer diameter of the second limiting rim, an outer diameter of the elastic cup holder middle sleeve is smaller than an inner diameter of the first limiting rim, an inner diameter of the elastic cup holder middle sleeve is larger than an outer diameter of the fourth limiting rim, and an inner diameter of the third limiting rim is larger than an outer diameter of the elastic cup bottom, such that the second limiting rim is slidable along an inner wall of the cup holder fixing seat, and the fourth limiting rim is slidable along an inner wall of the elastic cup holder middle sleeve.

When unfolded, the second limiting rim of the elastic cup holder middle sleeve is seated on and supported by the first limiting rim of the cup holder fixing seat, the fourth limiting rim of the elastic cup bottom is seated on and supported by the third limiting rim of the elastic cup holder middle sleeve.

The present invention has the following advantages. When folded, the elastic cup holder middle sleeve (or the main body of the elastic cup holder middle sleeve) is under the cup holder fixing seat by means of the second limiting rim and the first limiting rim. The elastic cup bottom (or the main body of elastic cup bottom) is under the elastic cup holder middle sleeve by means of the fourth limiting rim and the third limiting rim. The second limiting rim is slidable along an inner wall of the cup holder fixing seat, and the fourth limiting rim is slidable along an inner wall of the elastic cup holder middle sleeve. As a result, the cup holder is foldable and thus has a reduced height when folded. In addition, each of the bottom of the outer wall of the elastic cup holder middle sleeve and the bottom of the outer wall of the elastic cup bottom is provided with at least one limiting detention. When the cup holder is folded, the limiting detention is stopped by the corresponding first limiting rim and third limiting rim, preventing the elastic cup holder middle sleeve and the elastic cup bottom from falling off through an opening of the cup holder fixing seat.

When assembling, the component with a smaller diameter is sleeved in that with a larger diameter. The limiting detentions of the elastic cup holder middle sleeve are allowed to pass through the first limiting rim of the cup holder fixing seat by means of the deformation of the elastic cup holder middle sleeve. The limiting detentions of the elastic cup bottom are allowed to pass through the third limiting rim of the elastic cup holder middle sleeve by means of the deformation of the elastic cup bottom. Each limiting detention, when restored after the deformation, provides the position limiting function.

To sum up, the present invention is applicable to be removably attached to the frame of a chair such as a leisure chair. The present invention allows people to place a water cup, a coke cup, a drink, or the like in the cup holder and to have the drink when needed. The present invention provides the elastic cup holder middle sleeve in different depths (or heights), which can be conveniently replaced or interchanged. Moreover, the cup holder is removably attached to the frame of the leisure chair, so the assembling and detachment are simple. The cup holder is foldable and takes a smaller space when folded.

The methods and apparatus of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
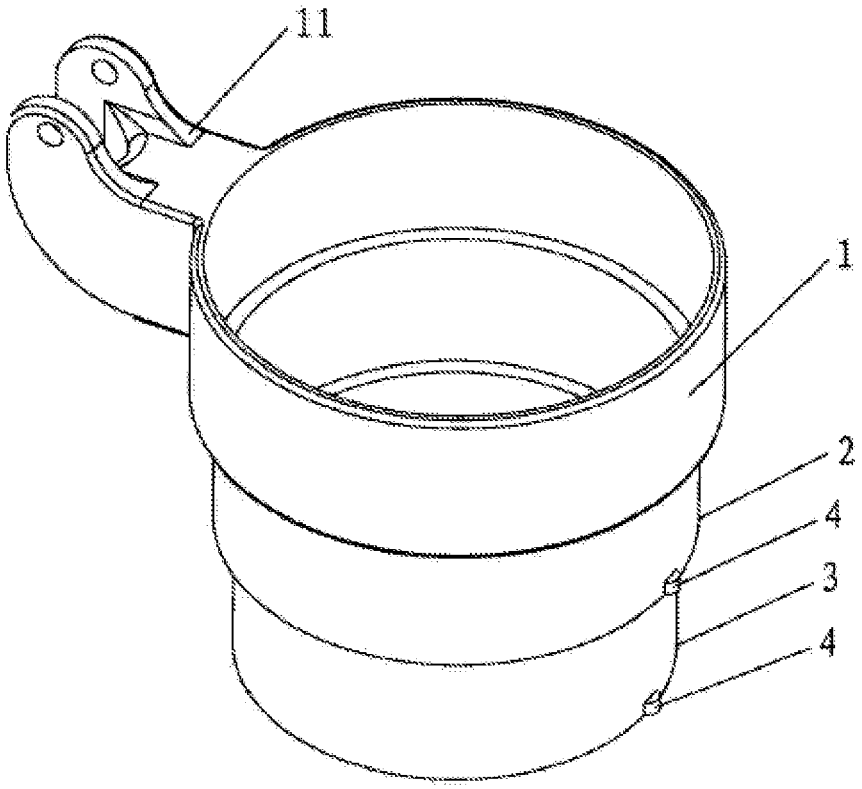
FIG. 1 is a schematic structural view illustrating an exemplary cup holder for a leisure chair according to the present invention.
Figure 2:
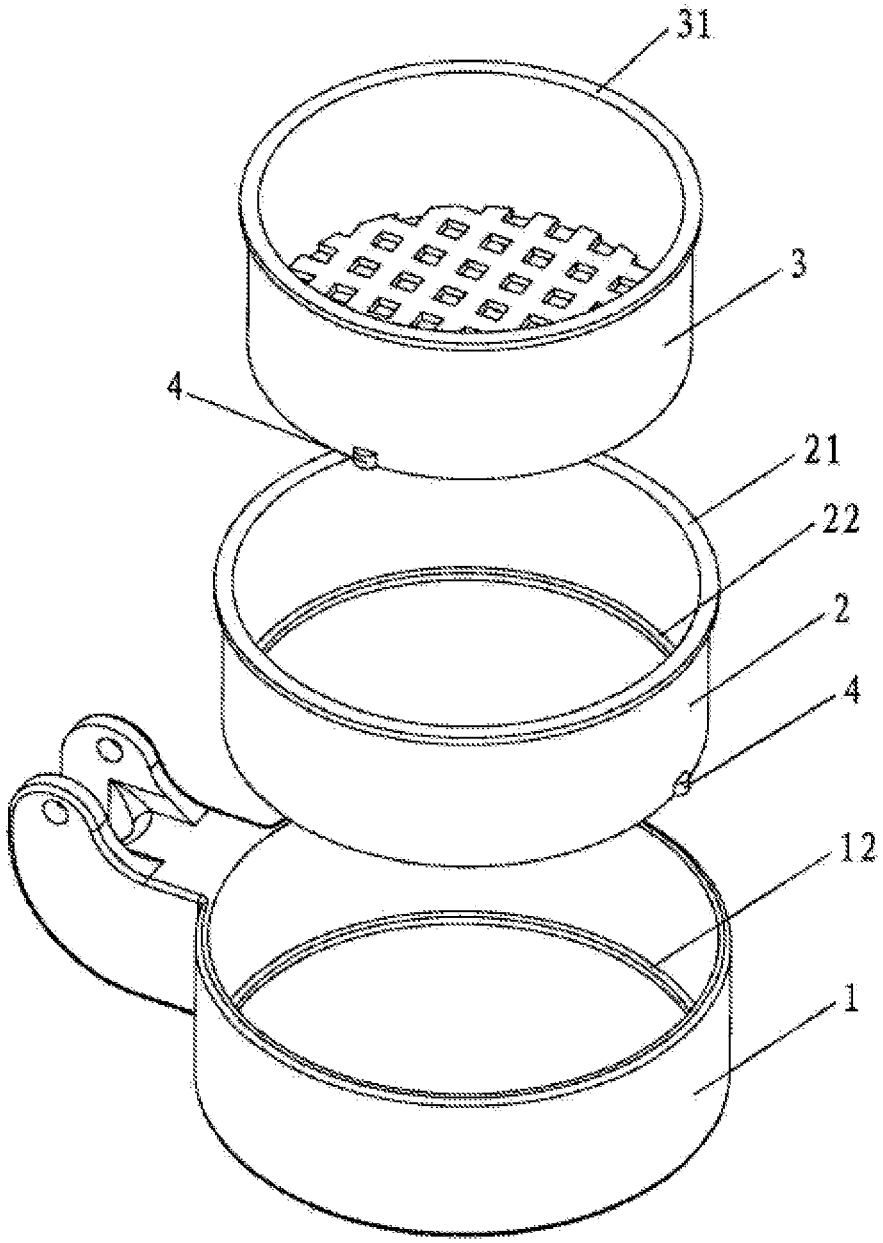
FIG. 2 is a schematic exploded view illustrating an exemplary cup holder for a leisure chair according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Referring to FIGS. 1-5, the present invention provides a cup holder (e.g., soda cup holder) for a chair (e.g., leisure chair). The cup holder can be used for holding a can (e.g., soda can), a bottle (e.g., water bottle), a cup (e.g., coffee) or the like. In various embodiments, the cup holder 10 includes a hollow cup holder fixing seat 1, a hollow cup holder middle sleeve 2, and a cup bottom 3. In some embodiments, the hollow cup holder middle sleeve 2 is an elastic cup holder middle sleeve, and the cup bottom 3 is an elastic cup bottom.

In some embodiments, cup holder fixing seat 1 is formed with connector 11 for removably attaching the cup holder to a frame of chair 20. In some embodiments, a lower edge of cup holder fixing seat 1 extends inward to form first substantially circular limiting rim (e.g., flange, shoulder or seat) 12. An upper edge of elastic cup holder middle sleeve 2 extends outward to form second substantially circular limiting rim (e.g., flange, shoulder or seat) 21. A lower edge of elastic cup holder middle sleeve 2 extends inward to form third substantially circular limiting rim (e.g., flange, shoulder or seat) 22. An upper edge of the elastic cup bottom 3 extends outward to form fourth limiting substantially circular limiting rim (e.g., flange, shoulder or seat) 31. In some embodiments, the bottom of the outer wall of the elastic cup holder middle sleeve 2 and the bottom of the outer wall of the elastic cup bottom 3 each is formed with at least one limiting detention (e.g., protrusion, clip, pin) 4.

In some embodiments, an inner diameter of cup holder fixing seat 1 is larger or slightly larger than an outer diameter of second limiting rim 21, an outer diameter of elastic cup holder middle sleeve 2 is smaller or slightly smaller than an inner diameter of first limiting rim 12, an inner diameter of elastic cup holder middle sleeve 2 is larger or slightly larger than an outer diameter of fourth limiting rim 31, and an inner diameter of third limiting rim 22 is larger or slightly larger than an outer diameter of elastic cup bottom 3;

When unfolded, the second limiting rim 21 of elastic cup holder middle sleeve 2 is seated on and supported by first limiting rim 12 of cup holder fixing seat 1. Fourth limiting rim 31 of elastic cup bottom 3 is seated on and supported by third limiting rim 22 of elastic cup holder middle sleeve 2. In other words, elastic cup holder middle sleeve 2 (or the main body of elastic cup holder middle sleeve 2) is under cup holder fixing seat 1, and the elastic cup bottom 3 or the main body of elastic cup bottom 3 is under elastic cup holder middle sleeve 2.

In some embodiments, second limiting rim 21 is slidably movable along an inner wall of cup holder fixing seat 1, and fourth limiting rim 31 is slidably movable along the inner wall of elastic cup holder middle sleeve 2. Therefore, when folding, the cup holder is collapsed. That is, elastic cup bottom 3 is stacked inside elastic cup holder middle sleeve 2 and elastic cup holder middle sleeve 2 is stacked inside cup holder fixing seat 1, reducing the height of the cup holder, saving storage space and enhancing the convenience of transporting the cup holder.

In some embodiments, each of the bottom of the outer wall of elastic cup holder middle sleeve 2 and the bottom of the outer wall of elastic cup bottom 3 is provided with at least one protrusion, functioning as limiting detention 4. In an exemplary embodiment, when the cup holder is collapsed, limiting detention 4 is stopped by corresponding first limiting rim 12 and third limiting rim 22, preventing the elastic cup holder middle sleeve 2 and the elastic cup bottom 3 from falling off through the opening of the cup holder fixing seat 1. Limiting detention 4 together with the first limiting rim 12 and third limiting rim 22 provides position limiting function.

Figure 3:
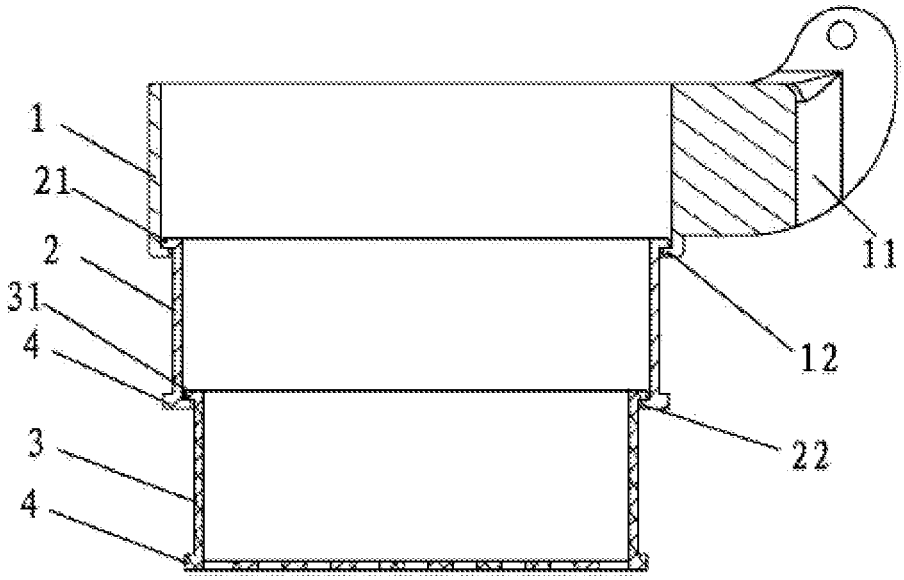
FIG. 3 is a cross-sectional view illustrating an exemplary cup holder for a leisure chair according to the present invention.
Figure 4:
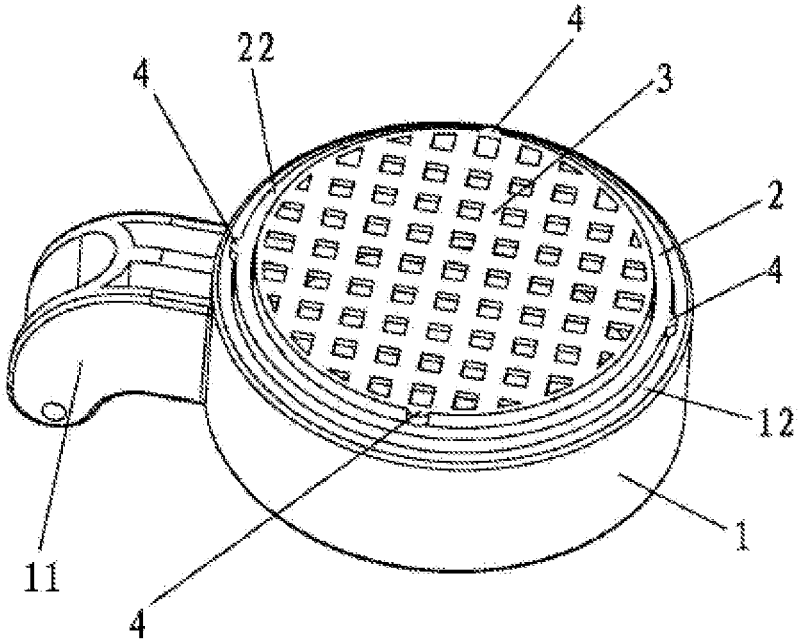
FIG. 4 is a schematic bottom view illustrating an exemplary cup holder for a leisure chair after collapsed according to the present invention.
Figure 5:
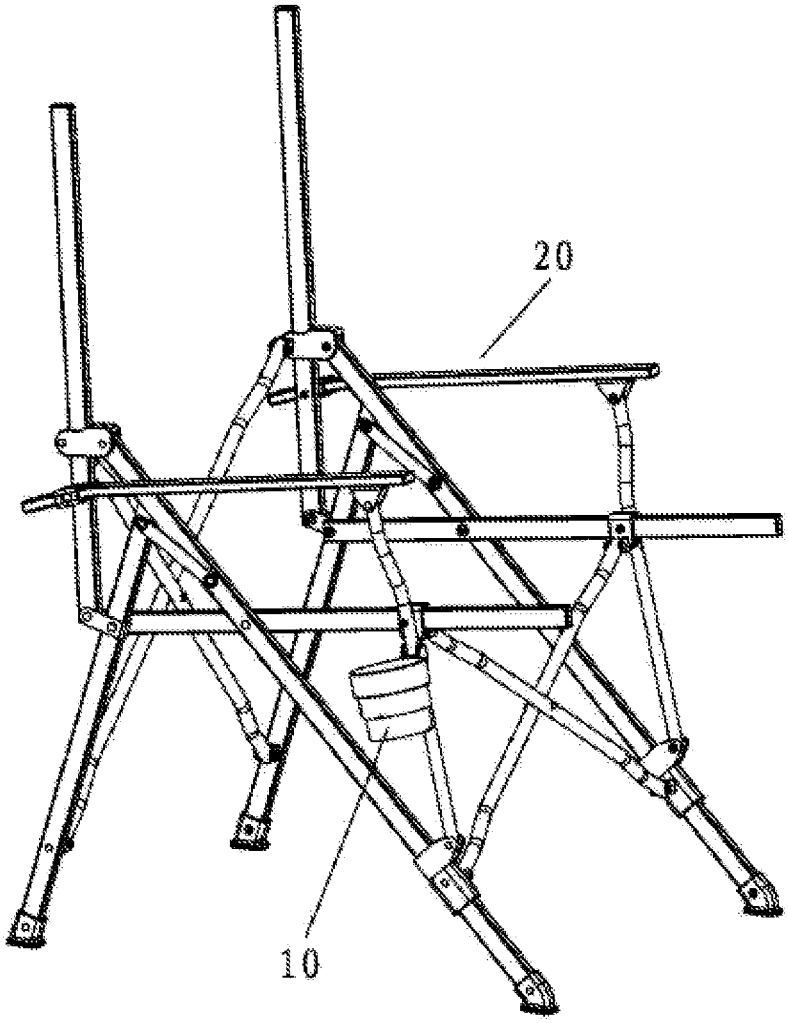
FIG. 5 is a schematic view illustrating an exemplary cup holder for a leisure chair when mounted on a frame of the leisure chair according to the present invention.

It is to be understood that the number of limiting detention (s) 4 arranged on each of the bottom of the outer wall of the elastic cup holder middle sleeve 2 and the bottom of the outer wall of the elastic cup bottom 3 can be readily varied. It is also to be understood that the way of arranging the limiting detention 4 on each of the bottom of the outer wall of the elastic cup holder middle sleeve 2 and the bottom of the outer wall of the elastic cup bottom 3 can be readily varied. By way of illustration, FIG. 3 and FIG. 4 show two limiting detentions 4, symmetric to each other, formed on each of the bottom of the outer wall of the elastic cup holder middle sleeve 2 and the bottom of the outer wall of the elastic cup bottom 3.

When assembling, the component with a smaller diameter is sleeved in the component with a larger diameter. The limiting detentions 4 of the elastic cup holder middle sleeve 2 are allowed to pass through the first limiting rim 12 of the cup holder fixing seat 1 by means of the deformation of the elastic cup holder middle sleeve 2. The limiting detentions 4 of the elastic cup bottom 3 are allowed to pass through the third limiting rim 22 of the elastic cup holder middle sleeve 2 by means of the deformation of the elastic cup bottom 3. Each limiting detention 4, when being restored after the deformation, is stopped by the first limiting rim 12 and the third limiting rim 22 when the cup holder is folded, providing the position limiting function. The elastic cup holder middle sleeve and the elastic cup bottom can be made of any suitable elastic materials such as plastic, elastic and rubber.

To sum up, in various embodiments, the present invention is optionally removably attached to the frame of a chair such as a leisure chair. The present invention allows people to place a water cup, a coke cup, a drink, or the like, in the cup holder and to have the drink when needed. The present invention provides the elastic cup holder middle sleeve in different depths (or heights), which can be conveniently replaced or interchanged. Moreover, the cup holder is removably attached to the frame of the chair, so assembly detachment are simple. The cup holder is foldable and takes up a small amount of space when folded.

For convenience in explanation and accurate definition in the appended claims, the terms "upper" or "lower", "top" or "bottom", "inner" or "outer", "inward" or "outward" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cup holder for a chair, comprising:

a hollow cup holder fixing seat including:

a connecting part for removably attaching the cup holder to a frame of the chair, and a first limiting rim extended radially inward from a lower edge of the cup holder fixing seat;

a hollow elastic cup holder middle sleeve including:

a second limiting rim extended radially outward from an upper edge of the elastic cup holder middle sleeve, a third limiting rim extended radially inward from a lower edge of the elastic cup holder middle sleeve, and at least one first detention formed at a bottom of an outer wall of the elastic cup holder middle sleeve; and an elastic cup bottom including:

a fourth limiting rim extended radially outward from an upper edge of the elastic cup bottom, and at least one second detention formed at a bottom of an outer wall of an elastic cup bottom, wherein, an inner diameter of the cup holder fixing seat is larger than an outer diameter of the second limiting rim, an outer diameter of the elastic cup holder middle sleeve is smaller than an inner diameter of the first limiting rim, an inner diameter of the elastic cup holder middle sleeve is larger than an outer diameter of the fourth limiting rim, and an inner diameter of the third limiting rim is larger than an outer diameter of the elastic cup bottom, such that the second limiting rim is slidable along an inner wall of the cup holder fixing seat, and the fourth limiting rim is slidable along an inner wall of the elastic cup holder middle sleeve; and wherein, when unfolded, the second limiting rim of the elastic cup holder middle sleeve is seated on and supported by the first limiting rim of the cup holder fixing seat, the fourth limiting rim of the elastic cup bottom is seated on and supported by the third limiting rim of the elastic cup holder middle sleeve.

2. The cup holder of claim 1, wherein one or more of the hollow elastic cup holder middle sleeve and the elastic cup bottom are made of a material comprising plastic, elastic or rubber.

3. The cup holder of claim 1, wherein the at least one first detention includes two detections formed at the bottom of the outer wall of the elastic cup holder middle sleeve and symmetric to each other.

4. The cup holder of claim 1, wherein the at least one second detention includes two detections formed at the bottom of the outer wall of the elastic cup bottom and symmetric to each other.

5. The cup holder of claim 1, wherein the at least one first detention and the at least one second detention, together with the corresponding first limiting rim and third limiting rim, prevent the elastic cup holder middle sleeve and the elastic cup bottom from falling off from the cup holder fixing seat.

* * * * *